United States Patent [19]

Dietrich et al.

[11] Patent Number: 4,625,682

[45] Date of Patent: Dec. 2, 1986

[54] CYLINDER HEAD

[75] Inventors: Werner Dietrich, Heppenheim; Gernot Langeloth, Mannheim, both of Fed. Rep. of Germany

[73] Assignee: Motoren-Werke Mannheim Aktiengesellschaft vorm. Renz Abt. stationärer Motorenbau, Mannheim, Fed. Rep. of Germany

[21] Appl. No.: 710,151

[22] Filed: Mar. 7, 1985

[51] Int. Cl.[4] ..... F01P 3/16

[52] U.S. Cl. ..... 123/41.31; 123/41.32; 123/41.82 R; 239/132.3

[58] Field of Search ..... 123/41.31, 41.32, 41.82 R, 123/193 H; 239/132, 132.1, 132.3

[56] References Cited

U.S. PATENT DOCUMENTS 3,315,652 4/1967 Ries et al. ..... 123/41.31
3,334,617 8/1967 Palkowski ..... 239/132.3
3,353,522 11/1967 Ley ..... 123/41.82 R
4,365,593 12/1982 Pomfret ..... 123/41.32

*Primary Examiner*—William A. Cuchlinski, Jr.
*Attorney, Agent, or Firm*—Browdy and Neimark

[57] ABSTRACT

A cylinder head for an internal combustion engine has at least one receptacle socket, penetrating a coolant chamber, for a spark plug and/or an injection valve. At one end, the socket rests tightly, with a frustoconical seating face, against a corresponding seating face of a seat embodied on a lower cylinder head wall, and at its other end the socket is retained in the associated cylinder head wall and is pressed axially against the seat. In order to attain particularly intensive cooling in the vicinity of the nozzle of the injection valve and/or the spark plug, the seating face on the respective socket is embodied as a female cone, and the associated seating face on the respective seat is embodied as a male cone, and the associated end faces of the respective socket are open toward the coolant chamber.

7 Claims, 2 Drawing Figures

CYLINDER HEAD

FIELD OF THE INVENTION

The present invention relates to a cylinder head for an internal combustion engine having at least one spark plug or injection valve receptacle socket which penetrates a coolant chamber and rests tightly with a frustoconical seating face at one end against a corresponding face of a seat on a lower cylinder head wall, while at its other end it is retained in the cylinder head wall and is pressed axially against the seat.

BACKGROUND OF THE INVENTION

In order to reduce fuel consumption and/or increase power in internal combustion engines, and/or to reduce toxic emissions and noise and/or to enable reliable operation with so-called alternative fuels, an intensive cooling of the cylinder head is necessary. In Diesel engines, the injection valves must be particularly well cooled in order to prevent carbonization of the nozzles. In Otto engines, the spark plugs must be particularly well cooled in order to avoid knocking. In pilot injection Diesel-alcohol engines, the pilot injection nozzle which is cooled very little must be thermally relieved by good cooling. In high-compression, spark-ignited Diesel-alcohol engines, the injection valves and the spark plugs must be cooled particularly intensively in order to assure the reliable operation of both elements. Finally, it is also desirable in Otto-type gaseous fuel (gas) engines to cool the spark plugs intensively.

From German Utility Model DE-GM No. 82 14 976.3, a cylinder head as generally described above is already known, the receptacle socket of which is embodied only for receiving an injection valve. In the vicinity of its end facing the lower cylinder wall, the socket is embodied with a seating face in the form of a male cone, which rests against a matching frustoconical seating face in the manner of an internal or female cone, which is embodied in the corresponding lower cylinder head wall. This assures a highly tight, radially and axially reliable seat for the receptacle socket on the lower cylinder head wall, which also brings about an improvement in cooling as compared with earlier conventional seat embodiments, so that fissures in the material are also reliably prevented. Under particularly severe thermal loads, however, the cooling in this area is still unsatisfactory.

SUMMARY OF THE INVENTION

It is accordingly the object of the present invention to embody a cylinder head of the above generic type in such a way, while retaining all its advantageous features, that still more intensive cooling is attained in the vicinity of the nozzle of the injection valve and/or of the spark plug.

This object is attained in accordance with the invention by embodying the seating face on the socket as a female cone and the seating face on the seat itself as a male cone and by providing that the ends of the socket are open toward the coolant chamber. As a result, the coolant is carried still closer to the nozzle of the injection valve, or to the igniting tip of the spark plug, because the receptacle socket is surrounded by the flow of coolant not only over its entire length but on its end face as well, to the extent that this end face is still present after manufacture. As a result of this extremely intensive flushing of the thermally highly stressed region, there is for instance attained in an Otto-type gas engine a shift of the knocking limit from $\lambda=1.3$ to $\lambda=1.0$, in the course of which a seat temperature of 220° C. (493 K.) was attained. In a conventional embodiment, an (unacceptable) seat temperature for the spark plug of 450° C. (723 K.) was reached. The use of so-called 3-way catalytic converters, which bring about a reduction of nitrogen monoxide emissions by a factor of 50 to 100, is possible only with this above-mentioned shift in the knocking limit. However, such 3-way catalytic converters can be used only within a very narrow $\lambda$ range between $1.0>\lambda>0.99$.

By providing very slight play of only a few tenths of a millimeter between the socket and the associated spark plug or injection valve in the area immediately adjacent the seat, a further improvement of the cooling in this area is attained. The invention further provides an optimal structural embodiment of the seating faces. In spark plug receptacle sockets according to the invention, sufficient space remains above the thermally stressed locations for socket wrenches to be inserted, in order to remove or secure the conventional spark plugs.

Further advantages and features of the invention will become apparent from the ensuing description of two exemplary embodiments, taken in conjunction with the drawings.

DESCRIPTION OF THE PREFERRED EMBODIMENTS

Figure 2:
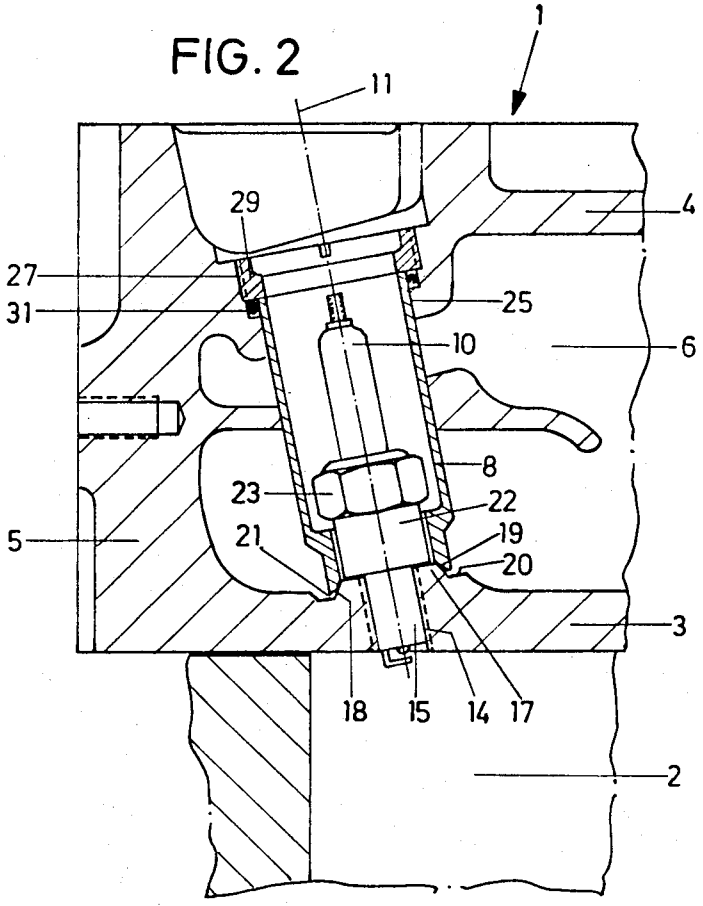
FIG. 2 is a section taken through a fragmentary view of a cylinder head according to the invention, having a receptacle socket for a spark plug.

Both figures of the drawing show a fragmentary view of a cylinder head 1, which has a lower cylinder head wall 3 oriented toward a cylinder 2, a upper cylinder head 4 at the opposite end, and lateral cylinder head walls 5. The cylinder head walls 3, 4, 5 among themselves define a coolant chamber 6.

Figure 1:
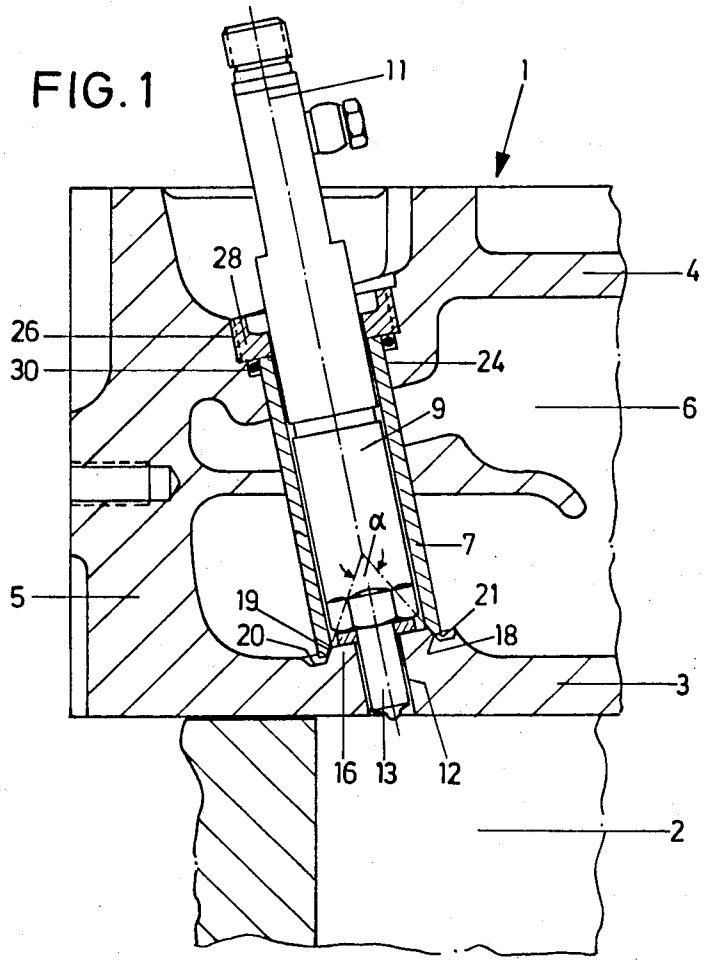
FIG. 1 is a section taken through a fragmentary view of a cylinder head according to the invention, having a receptacle socket for an injection nozzle.

The coolant chamber 6 is penetrated by a receptacle socket 7 or 8, the receptacle socket 7 in FIG. 1 being embodied for receiving an injection valve 9 and the socket 8 of FIG. 2 being embodied for receiving a spark plug 10. To this end, the receptacle socket 7 is substantially embodied as a straight segment of a tube, while the receptacle socket 8 is restricted in the vicinity of its lower end facing the cylinder 2.

A bore 12 for the nozzle 13 of the injection valve 9 or a threaded bore 14 for receiving the igniting tip 15 of the spark plug 10 is embodied in the lower cylinder head wall 3, coaxially with the central longitudinal axis 11 of the receptacle sockets 7, 8.

In accordance with the conventional structure of an injection valve 9 or a spark plug 10, both bores 12, 14 have markedly smaller diameter than the receptacle socket 7 or 8 in the immediately adjacent region, so that there is space in he transitional zone from the receptacle socket 7 or 8 to the corresponding bore 12 or 14 for embodying a frustoconical seat 16 or 17, extending toward the socket 7 or 8, for the socket 7 or 8. Each seat 16 or 17 has a seating face 18 tapering frustoconically toward the receptacle socket 7 or 8 and toward the central longitudinal axis 11, and a corresponding seat face 19, embodied as a female cone, at the lower edge of the respective socket 7 or 8 and associated with the seating face 18. The respective seat 16 or 17 is provided with an undercut 20 such that the ends 21 associated with the lower cylinder head wall 3 and the entire outside of the respective socket 7 or 8 are flushed with the coolant.

The receptacle socket 7 furthermore surrounds the injection valve 9 with an air gap of only a few tenths of a millimeter. The same applies to the receptacle socket 8, the lower portion of which, adjacent to the seat 17, is severely restricted, so that again a gap of only a few tenths of a millimeter remains between the socket 8 on the one hand and the cylindrical section 22, embodied between the igniting tip 15 and the hexagon 23, on the other. As a result of this embodiment, a particularly intensive cooling takes place in the vicinity of the maximum thermal load, because the coolant is carried particularly close to the thermally stressed locations. The frustoconical seating faces 18, 19 embodied complementary to one another include between them an angle of $\alpha=60°$ to 90°. Naturally, they rest against one another in a watertight manner.

A respective bore 24 or 25 is embodied in the upper cylinder head wall 4, its diameter being substantially equal to the outside diameter of the receptacle socket 7 or 8 in this region, so that the socket is retained without radial play in this bore 24 or 25. A wider bore 26, 27 adjoins the bore 24 or 25 at the top and is provided in the vicinity of its free end with a thread, into which a flat threaded nut 28, 29 is screwed with considerable torque, so that with a corresponding force it clamps the receptacle socket 7 or 8 against the respective seat 16 or 17; as a result, the connection between the receptacle socket 7 or 8 and the lower cylinder head wall 3 becomes not only axially and radially firm but also absolutely watertight, even during the functionally dictated "breathing" of the cylinder head 1. In the vicinity of the wider bore 26 or 27 located between the threaded nut 28 or 29 and the bore 24 or 25, there is an annular seal 30 or 31, which seals off the coolant chamber 6 from the outside, that is, toward the top of the cylinder head 1/.

It is to be understood that the foregoing text and drawings relate to embodiments of the invention described by way of example but not limitation, other embodiments and variants of the invention being possible within the spirit and scope of the invention.

What is claimed is:

1. In a cylinder head for an internal combustion engine, having at least one receptacle socket, penetrating a cooling chamber, for a spark plug or an injection valve, which socket rests tightly at one end thereof, with a frustoconical seating face, against a corresponding seating face of a seat on a lower cylinder head wall, and at its other end is retained in a cylinder head wall and pressed axially against the seat, the improvement wherein the seating face (19) on the receptacle socket (7 or 8) is a female cone and the corresponding seating face (18) on the seat (16 or 17) is embodied as a male cone, and the end (21) of the receptacle socket (7 or 8) is open towards the cooling chamber (6).

2. A cylinder head as defined by claim 1, whrein immediately adjacent the seat (16 or 17) between the socket (7 or 8) and a corresponding section (22) of an injection valve (9) or spark plug (10) retained therewithin there is a space of only a few tenths of a millimeter.

3. A cylinder head as defined by claim 2, wherein the seating face (18 or 19) has an included angle ($\alpha$) of approximately 60° to 90° toward the resepctive receptacle socket (7 or 8).

4. A cylinder head having a receptacle socket for a spark plug, as defined by claim 2, wherein the receptacle socket (8) has a smaller diameter portion adjacent to the seat (7).

5. A cylinder head as defined by claim 1, wherein the seating face (18 or 19) has an included angle ($\alpha$) of approximately 60° to 90° toward the respective receptacle socket (7 or 8).

6. In a cylinder head for an internal combustion engine, having at least one receptacle socket, penetrating a cooling chamber, for a spark plug or an injection valve, which socket rests tightly at one end thereof, with a frusto-conical seating face, against a corresponding seating face of a seat on a lower cylinder head wall, and at its other end is retained in a cylinder head wall and pressed axially against the seat, the improvement wherein the seating face on the receptacle socket is a female cone and the corresponding seating face on the seat is embodied as a male cone, and the one end of the receptacle socket including a lowermost end surface exposed to coolant in the cooling chamber, whereby during operation of the engine, optical cooling of an injection valve nozzle or a spark plug igniting tip may be achieved due to the receptacle socket being surrounded by the flow of coolant not only over its entire length but also on its lowermost end surface.

7. In a cylinder head for an internal combustion engine including at least one cylindrical receptacle socket, penetrating a coolant-containing chamber, for a spark plug or injection valve, the socket having a frusto-conical seating face at one end thereof making tight engagement with a corresponding seating face on a lower cylinder head wall, and the socket having its opposite end retained in a cylinder head wall and pressed axially toward the corresponding seating face, the improvement comprising:

said receptacle socket one end including a first annular surface defining a female cone and a second annular surface defining the lowermost end of said receptacle socket, and said corresponding seating face of said lower cylinder head wall including an annular surface defining a male cone and annular recessed means, surrounding said male cone, for exposing said receptacle socket second annular surface to coolant in said cooling chamber when said receptacle socket female cone is firmly seated on said male cone.

* * * * *